US006897834B2

(12) United States Patent
McCormack

(10) Patent No.: US 6,897,834 B2
(45) Date of Patent: May 24, 2005

(54) MATRIX DISPLAY DRIVER WITH ENERGY RECOVERY

(75) Inventor: James Joseph Anthony McCormack, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 260 days.

(21) Appl. No.: 09/932,085

(22) Filed: Aug. 17, 2001

(65) Prior Publication Data

US 2002/0041275 A1 Apr. 11, 2002

(30) Foreign Application Priority Data

Aug. 22, 2000 (EP) ..... 00202932

(51) Int. Cl.[7] ..... G09G 3/20; G09G 3/28

(52) U.S. Cl. ..... 345/55; 345/60; 345/67; 345/68

(58) Field of Search ..... 345/55, 60, 67–70; 315/169.4

(56) References Cited

U.S. PATENT DOCUMENTS 4,866,349 A * 9/1989 Weber et al. ..... 315/169.4
5,670,974 A * 9/1997 Ohba et al. ..... 345/60
6,111,556 A * 8/2000 Moon ..... 345/60
6,483,490 B1 * 11/2002 Lo ..... 345/60

* cited by examiner

*Primary Examiner*—Jimmy H. Nguyen

(57) ABSTRACT

In the matrix display drive circuit with an energy recovery inductor (L1), a switch circuit (S3, D3, S6, d9) is connected in parallel with the inductor (L1) to keep the inductor current (TL1) in a loop which is as small as possible, and to keep the voltage (VL1) across the inductor (L1) as low as possible. Consequently, the energy stored in the inductor is lower, and the EM1 caused by the parasitic resonance of the inductor (L1) with parasitic capacitances Cj will be significantly lower.

9 Claims, 5 Drawing Sheets

MATRIX DISPLAY DRIVER WITH ENERGY RECOVERY

TECHNICAL FIELD

Figure 1:
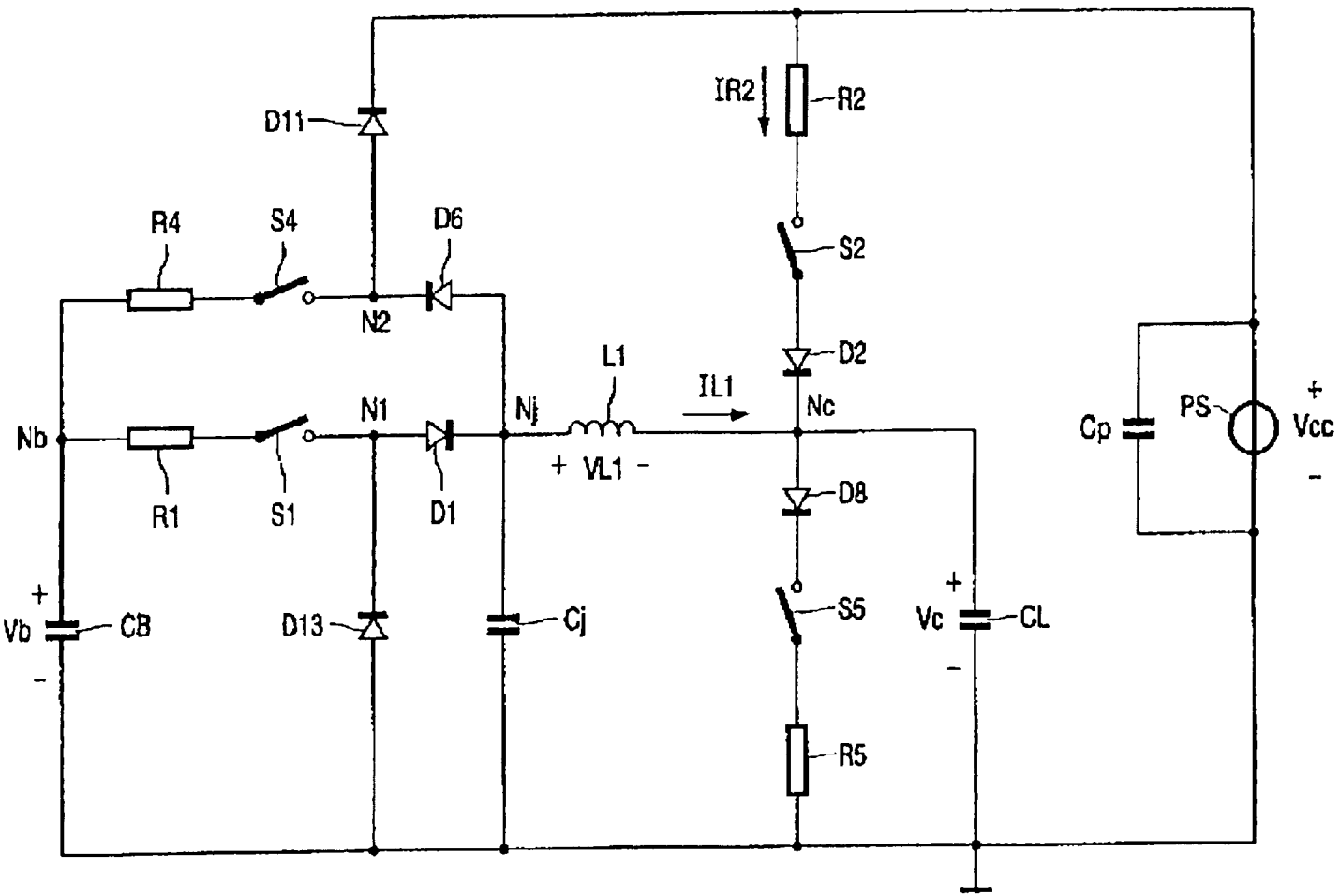
FIG. 1 PRIOR ART

The invention relates to an energy recovery matrix display driver circuit, and a matrix display apparatus with such a driver circuit.

BACKGROUND AND SUMMARY

Alternating voltages are required between electrodes of matrix displays like LCDs, Plasma Display Panels (PDP), Plasma Addressed Liquid Crystal displays (PALC), and Electro-Luminescent panels (EL). Due to a capacitance present between the electrodes, and required steep slopes of the alternating voltage, relatively large charge or discharge currents are required to reverse the polarity of the voltage across the capacitance. To minimize the power dissipation during the polarity reversal, driver circuits which comprise an energy recovery circuit in which an external inductance forms a resonant circuit with the capacitance are known from EP-A-0548051 and EP-A-0704834. Both these prior arts disclose an energy recovery circuit for a PDP.

A PDP may be driven in a sub-field mode wherein, during a field or a frame of the video information to be displayed, a plurality of successive sub-fields or frames occurs. A sub-field comprises an addressing phase and a sustaining phase. During the addressing phase, the plasma rows are usually selected one by one and data in conformance with the video information to be displayed is written into pixels of the selected row. During the sustaining phase, a number of sustain pulses is generated dependent on the weight of the sub-field. Pixels pre-charged during the addressing phase to produce light during the sustaining phase will emit an amount of light during the sustaining phase which corresponds to the weight of the sub-field. The total amount of light produced by a pixel during the field or frame period of the video information depends, on the one hand, on weights of the sub-fields and, on the other hand, on the sub-fields during which the pixel was pre-charged to produce light.

In a PDP, the electrodes may be the scan electrodes and the common electrodes. Cooperating scan electrodes and common electrodes form pairs which are each associated with one of the plasma channels. During the sustaining phase, the pairs of electrodes are driven with anti-phase square-wave voltages generated by a full-bridge circuit. The full-bridge circuit comprises a first series arrangement of a first and a second controllable switch and a second series arrangement of a third and a fourth controllable switch. A junction of main current paths of the first and the second switch is coupled to a scan electrode. A junction of main current paths of the third and the fourth switch is coupled to a common electrode. The first series arrangement and the second series arrangement are arranged in parallel across terminals of a power supply source. The main current path of the first switch, is arranged between the scan electrode and a first one of the terminals, the main current path of the third switch, is arranged between the common electrode and said first terminal. During a first phase of a sustaining period, two of the switches are open while two of the other switches are closed, such that the power supply voltage supplied by the power supply source is available in a first polarity between the cooperating electrodes and thus across the capacitance. During a second phase of the sustaining period, the switches which were open during the first phase are now closed, and the switches which were closed are now open, such that the power supply voltage supplied by the power supply source is available in the reversed polarity between the cooperating electrodes.

Figure 2:
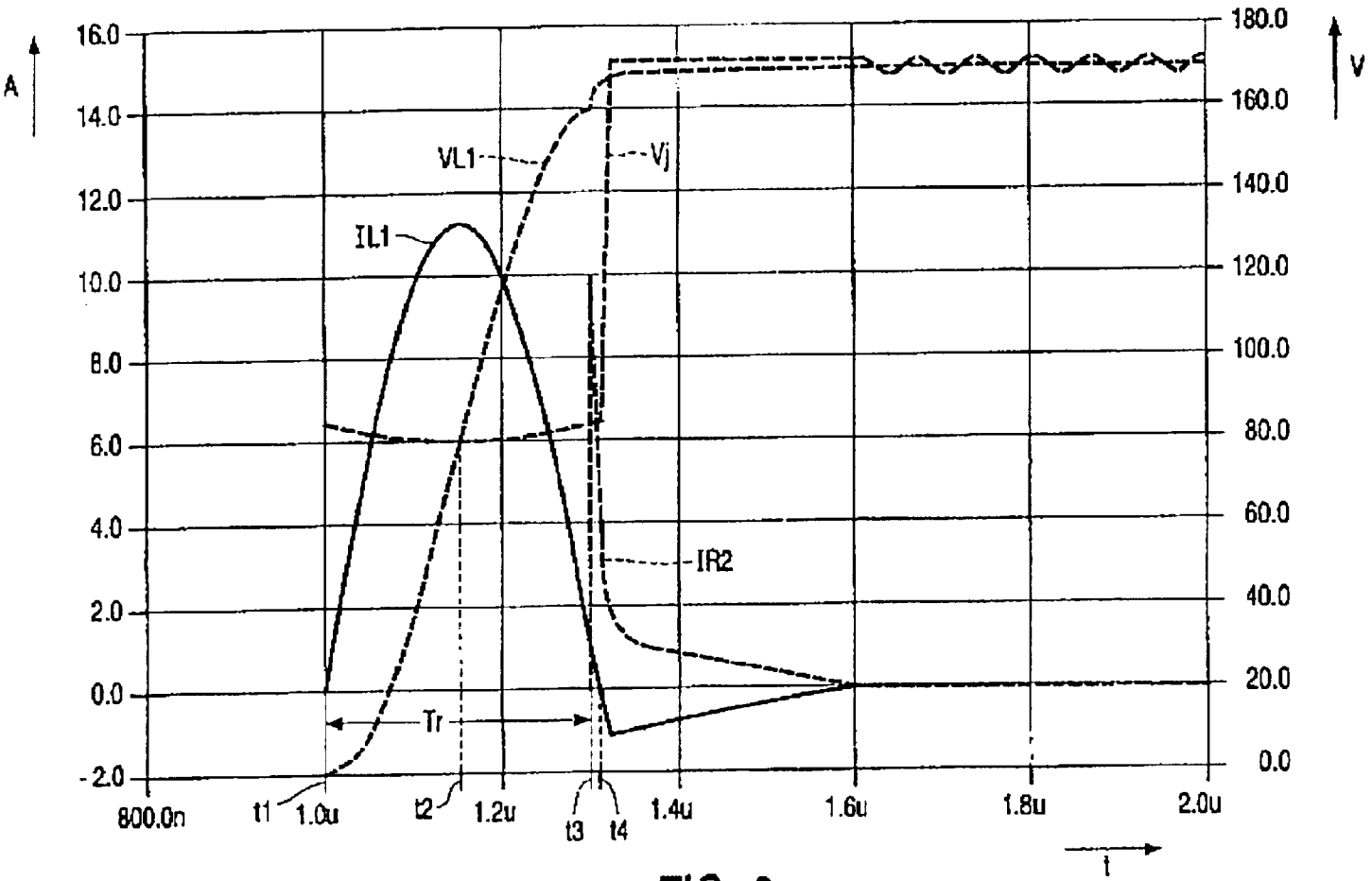
FIG. 2 PRIOR ART

A detailed description of this prior-art circuit and its operation is given in the description of FIG. 1 and FIG. 2.

Although the prior-art energy recovery circuit provides an efficient energy recovery, this circuit produces a considerable amount of Electro-Magnetic Interference (EMI).

It is, inter alia, an object of the invention to provide an efficient energy recovery circuit which produces less Electro-Magnetic Interference.

To this end, a first aspect of the invention provides an energy recovery matrix display driver circuit. Other aspects provide a matrix display apparatus comprising such an energy recovery matrix display driver circuit, and other advantageous embodiments.

At the end of a resonance period, when the current through the inductor changes polarity, this current has to follow a path that starts at one terminal of the inductor and ends at the other terminal of the inductor. In the prior art, this current has to flow via several diodes and one of the full-bridge switches (which is referred to as the second switch in the following description and in the claims). Thus, this current will flow through a loop with a large area and consequently generate a large electromagnetic field. As this second switch has to withstand a large voltage in a practical implementation, its impedance is quite high. Therefore, the voltage across the inductor will be quite high and thus an amount of energy stored in the inductor will be quite high. As the switch which connects the inductor and the capacitance to form a resonant circuit (this switch is referred to as the first switch in the following description and in the claims) has to be opened at or after the end of the resonance period to allow, at a start of the next resonance period, a change of the polarity of the voltage across the capacitive load in the opposite direction with respect to the first resonance period, the energy stored in the inductor will cause a high-frequency oscillation with a parasitic capacitance at the terminal of the inductor connected to the first switch.

The invention is based on the insight that this high-frequency oscillation is a major contributor to the EMI produced. In practice, the problem of the prior art is even more severe as the current in the loop through the second switch has to flow through two or three diodes, causing a voltage across the inductor which is the addition of two or three diode forward voltages and the voltage across the second switch.

In the circuit in accordance with the invention, an extra switch circuit is connected in parallel with the inductor to keep the above-mentioned current in a loop which is as small as possible. Furthermore, the switch circuit has to withstand a lower voltage than the second switch and will have a lower impedance in a practical implementation. But most importantly, the two or three diodes are not within the loop. Even if a unidirectional switch circuit is required, only one instead of two or three diodes is in the loop. Thus, in the circuit in accordance with the invention, the voltage across the inductor will be significantly lower than in the prior art. Consequently, the energy stored in the inductor is lower, and the EMI caused by the parasitic resonance will be significantly lower.

In an embodiment of the present invention, the switch circuit comprises a series arrangement of a diode and a controllable switch. This has the advantage over a controllable switch only that the timing of the on-time of the switch is less critical. It is no problem when the switch is on when the current through the inductor has such a polarity that the diode blocks.

In a further embodiment of the present invention, the energy recovery circuit has been made symmetrical to obtain an optimal efficiency in both resonance phases.

In yet another embodiment of the present invention, due to the presence of the switch circuit, it is possible to close the second switch at a later instant to prevent current flowing from the power supply voltage via the second switch at a later instant to prevent current flowing from the power supply voltage via the second switch to the capacitive load. In this way, less power is drawn from the power supply, and the efficiency even further improves.

These and other aspects of the invention are apparent from and will be elucidated with reference to the embodiments described hereinafter.

BRIEF DESCRIPTION OF THE DRAWINGS FIGURES

Figure 3:
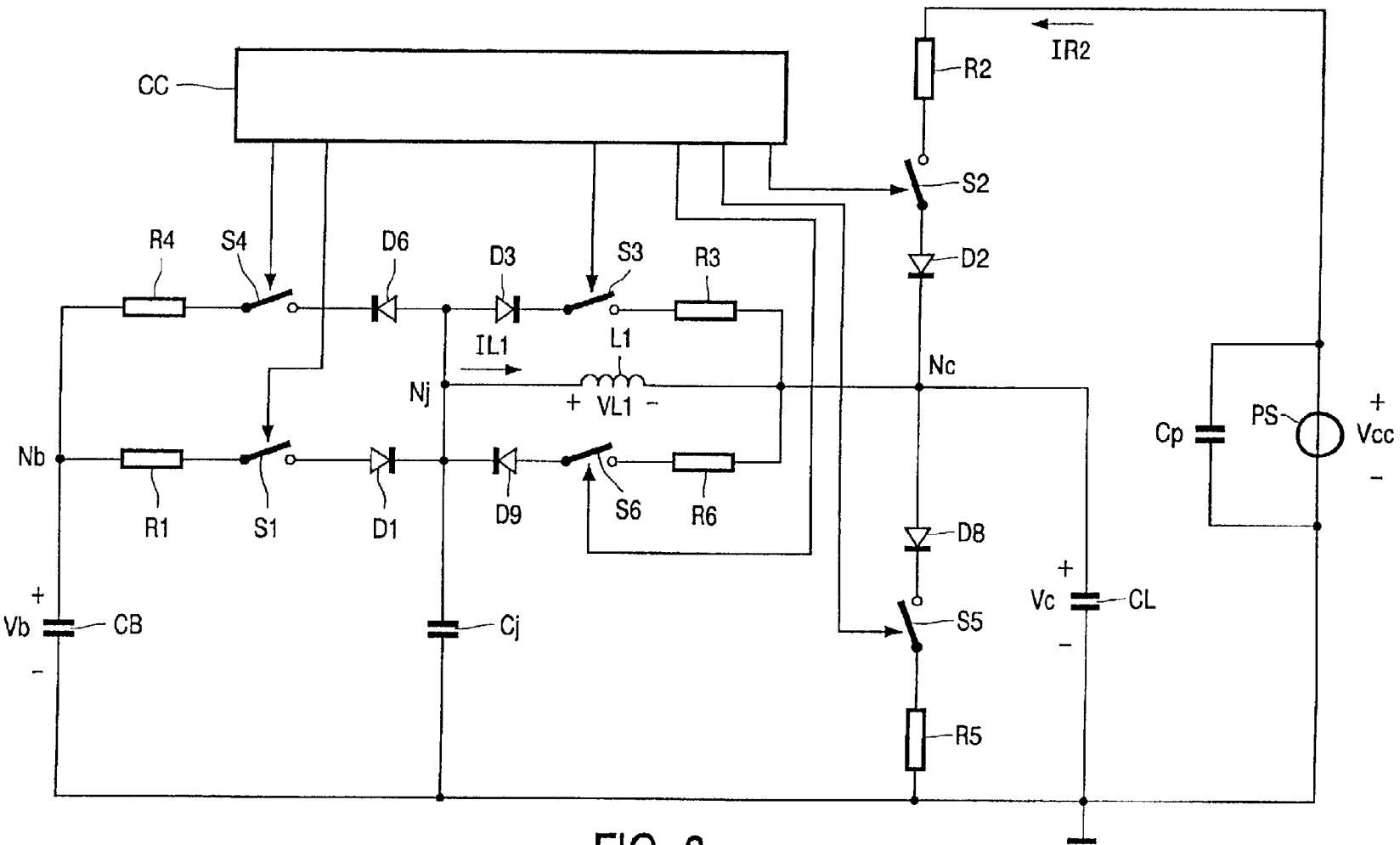
Figure 4:
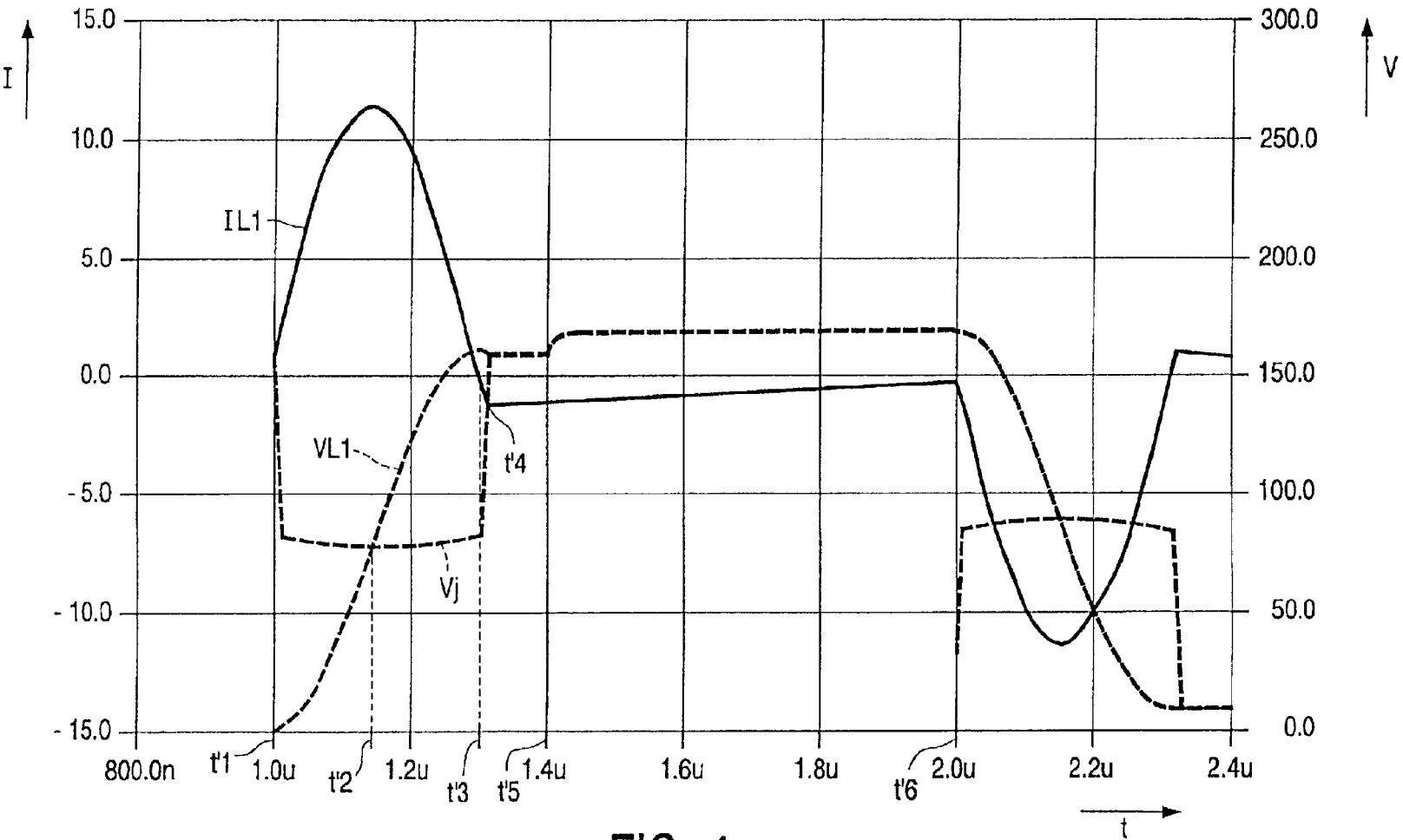
Figure 5:
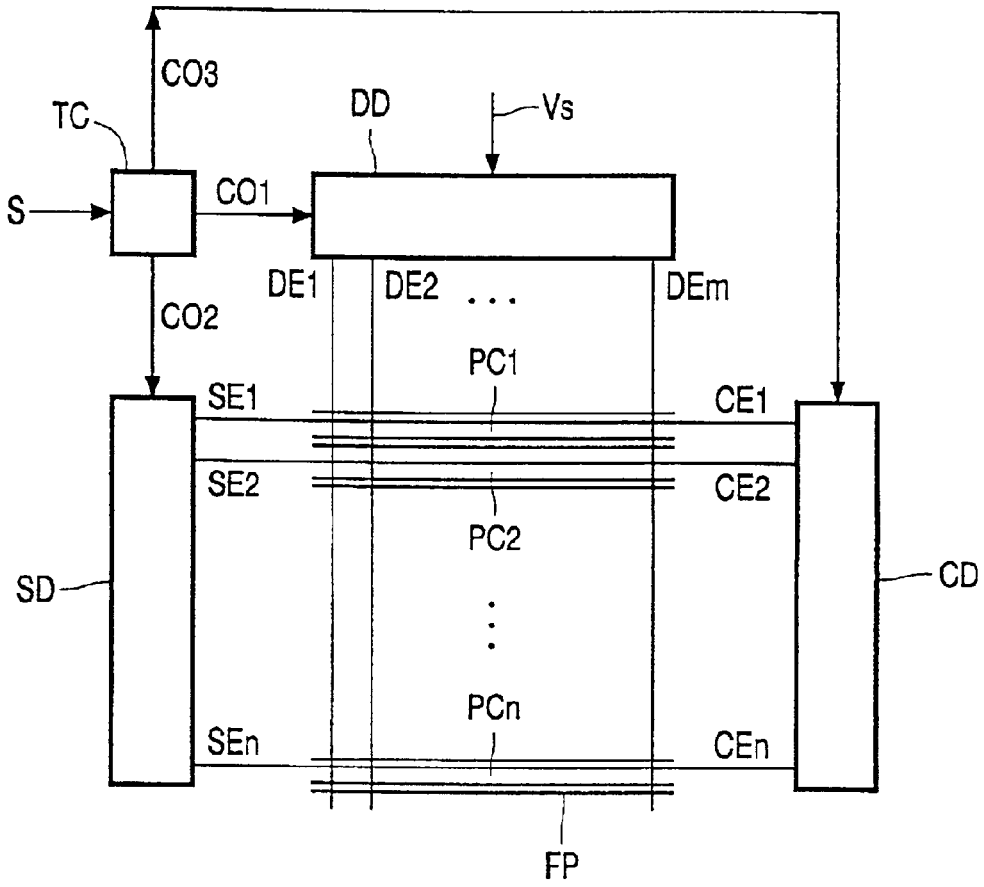

In the drawings:

FIG. 1 is a detailed circuit diagram of a prior-art matrix display driver circuit with energy recovery, FIG. 2 shows waveforms of signals occurring in the circuit of FIG. 1, FIG. 3 is a detailed circuit diagram of an embodiment of a matrix display driver in accordance with the invention, FIG. 4 shows waveforms of signals occurring in the circuit of FIG. 3, and FIG. 5 shows a matrix display and a block diagram of circuits driving the matrix display.

DETAILED DESCRIPTION OF THE DRAWING FIGURES

FIG. 1 is a detailed circuit diagram of a prior-art matrix display driver circuit with energy recovery.

The driver circuit comprises a buffer capacitor CB arranged between a node Nb and ground. A series arrangement of an ideal switch S1 and a resistor R1 is connected between the node Nb and a node N1. A series arrangement of an ideal switch S4 and a resistor R4 is connected between the node Nb and a node N2. All series arrangements of an ideal switch and a corresponding resistor represent a practical switch (for example, a MOS-FET) with an on-resistance equal to the resistor value. The resonance inductor L1 is arranged between a node Nj and a node Nc. The current IL1 through the inductor is defined to flow from the node Nj to the node Nc. The voltage VL1 across the inductor is the voltage difference between the node Nj and the node Nc. The node Nj is connected to the node N1 via a diode D1, and to the node N2 via a diode D6. The cathode of the diode D1 and the anode of the diode D6 are connected to the node Nj. A diode D13 has an anode connected to ground and a cathode connected to the node N1. A diode D11 has an anode connected to the node N2 and a cathode connected to a positive pole of a power supply source PS which supplies a power supply voltage Vcc. The other pole of the power supply source PS is connected to ground. A capacitor Cp is arranged in parallel with the power supply source PS. A series arrangement of an ideal switch S2, a resistor R2, and an optional diode D2 is connected between the node Nc and the positive pole of the power supply source PS. The cathode of the diode D2 is directed to the node Nc. A series arrangement of an ideal switch S5, a resistor R5, and an optional diode D8 is connected between the node Nc and ground. The anode of the diode D8 is connected to the node Nc. The two diodes D2 and D8 are not disclosed in the prior art. The capacitive load CL is connected between the node Nc and ground. The voltage across the capacitive load CL is denoted by Vc and is the voltage difference between the node Nc and ground. Vj denotes the voltage between the node Nj and ground. The current IR2 flows through the resister R2.

The essence of this circuit is to store the blind energy in a reservoir, which is the buffer capacitor CB, and to pass the energy back and forth to the load capacitance CL. This passing back-and-forth is realised by building two parallel-switched one-way current paths with opposing directions (S1 and D1, S4 and D6) and using a lossless inductor L1 in between. The function of the inductor L1 is to ensure that the right amount of energy is passed to the load CL before stopping the current upon reversal of current direction through the inductor. This occurs after a half period of the resonance of the series resonance loop formed by the inductor L1 and the load capacitance CL. In order to operate efficiently, the buffer capacitor CB has a far greater value than the load capacitance CL, thus ensuring that the buffer voltage remains relatively stable regardless of charge transfer to and from the load CL. Hence the loop capacitance is approximately equal to the load CL. Let it be assumed that the total series resistance in the resonance loop is mainly formed by the switch resistance and parallel diode resistance and that the resonance loop has a resonance frequency fres. This means that the factor of blind energy retained after one cycle is:

$$e^{-\left(\frac{\pi R}{2\sqrt{\frac{L_1}{CL}}}\right)}$$

The switching time Tsw allowed is fixed by the time to gas breakdown. The Q in this loop is high and this means that the natural frequency is not shifted by damping, and thus:

$$f_{res} = \frac{1}{2\pi\sqrt{L_1 \times CL}} = \frac{1}{T_{res}} \;\&\; T_{sw} = \frac{T_{res}}{2} \Rightarrow L_1 = \left(\frac{T_{sw}}{\pi}\right)^2 \frac{1}{CL}$$

It can be concluded that L1 and CL are inversely proportional in this circuit. Furthermore, by substituting the equation above for L, the amount of blind energy retained after one cycle can be written as:

$$e^{-\left(\frac{\pi^2 R*CL}{2Tsw}\right)}$$

Given the high quality factor Q of the resonance loop, the term 'R*CL' is small with respect to Tsw, and thus the above can be approximated by:

$$1-\left(\frac{\pi^2 RCL}{2Tsw}\right)$$

Hence, the blind energy loss factor is approximately:

$$\left(\frac{\pi^2 RCL}{2Tsw}\right)$$

Inductor-switch can be placed in parallel without mutual interference. In this way, the load is spread across more circuits, or circuit resistances are placed in parallel. Either way, the effect of placing n such circuits in parallel is to give the following approximate blind energy loss factor:

$$\left(\frac{\pi^2 RCL}{2nTsw}\right)$$

Based on the above, the following conclusions can be drawn:

1. An increased screen size gives an increased load CL and thus an equivalently increased loss factor.

2. An increased number of parallel circuits hyperbolically decreases the loss factor.

3. Faster gases for higher scanning frequencies, and more light from faster prime, etc., means a lower Tsw and thus equivalently increased loss factor.

4. A higher resolution and larger screen sizes (HDTV/SVGA) mean a lower Tsw and a higher capacitive load CL, respectively, and thus a quadratically increased loss factor.

For example, in a practical 21" plasma display the load CL was 28 nF spread across 2 circuits. Tsw was set at 300 ns by using an inductor L1 of 0.7 H in each circuit. The resistance per switch was of the order of 200 mOhms. The sustain cycle took about 9.6 us.

FIG. 2 shows waveforms of signals occurring in the circuit of FIG. 1. The horizontal axis represents the time t, the left-hand vertical axis represents the current I in Amperes, and the right-hand vertical axis represents the voltage V. The values shown along the axis are merely intended as examples.

Let it be assumed that the circuit has been active long enough for the voltage Vb across the buffer capacitor CB to have settled halfway between the supply and ground potential (i.e. Vb is Vcc/2). The load CL is assumed be to at ground potential with respect to the sustain side (the scan side of the load forms a virtual ground because it is switched to ground during the active phase of this circuit). All switches are open at start. The cycle begins when the switch S1 closes at the instant t1. Energy is then sent to the load CL from the buffer CB via the inductor L1 in a resonant way. When the switch S1 closes, the floating end of the inductor (the node Nj) is clamped to the buffer voltage Vb via the diode D1. Current then builds up through the inductor L1 until the load voltage Vc equals the buffer voltage Vb at the instant t2. After this, the voltage across the inductor L1 reverses and hence the current IL1 through it decreases. The switch 2, which is the switch through which the current for arcing is supplied after gas breakdown, is closed at just before the end of the energy recovery cycle (at the instant t3). At this point, the remaining energy is supplied to the load capacitance CL from the supply PS as well as from the buffer CB. The diode D2 is conducting. The inductor current IL1 reaches zero at the instant t4. If the diode D1 were ideal, then at this point the current IL1 through the inductor L1 and the switch S1 would cease. However, diodes have a reverse recovery time, which means that a small reverse current (energy from load CL to buffer CB) is able to build up in the inductor L1 before the diode D1 goes into the reverse state. However, the current IL1 through the inductor L1 must be continuous when the diode D1 stops conducting, and thus the capacitance Cj at the node Nj charges up until the diodes D6 and D11 close due to forward bias, and the rest of the inductor current IL1 flows back to the inductor L1 through the supply PS and/or the capacitor Cp, and/or through the diode D2, depending on the impedances in both paths. The voltage VL1 across the inductor L1 is now approximately three diode drops (D6, D11, D2) plus the voltage drop across the resistance R2 of the switch S2. This means that the negative current through the inductor L1 decreases until the diodes D6 and D11 stop conducting (forward bias too low). The remaining energy in the inductor L1 then oscillates back and forth with the stray capacitance Cj at the node Nj, the average voltage at this node is equal to the load voltage Vc. In the situation where the optional diode D2 is not present, the voltage across the inductor L1 will be approximately two diode drops plus the voltage drop across the switch S2.

A similar set of events occurs at the instant when the load voltage Vc is brought back to zero and the energy is returned to the buffer Cb. The switch S4 closes, the diode D6 conducts and the node Nj is clamped to the buffer voltage Vb. This gives rise to a reverse voltage across the inductor L1 and a current IL1 builds up from the load CL to the buffer CB through it. The switch 5 closes at the end of the resonance, helping to drain the charge out of the load CL. The current IL1 though the inductor L1 changes direction (goes positive). When the diode D6 stops conducting, the capacitance Cj at the node Nj is discharged until the diodes D1 and D13 are forward biased. At this point, the inductor current IL1 flows through these diodes and D8. The reverse voltage across the inductor VL1 is now approximately three diode drops (D1, D13, D8) plus the voltage drop across the resistance R6 of the switch S5. This means that the positive current through the inductor L1 decreases until the diodes D1 and D13 stop conducting. The remaining energy in the inductor L1 then oscillates back and forth with the stray capacitance Cj at node Nj, and the average voltage at this node Nj is equal to the load voltage Vc (i.e ground potential).

Six primary areas of power loss in this circuit with respect to energy recovery are found to be important:

1. Circuit resistance including switches and diodes (see blind energy loss factor).

2. Diode forward drops during conduction in the branches of the switches S1 and S4.

3. Diode reverse recovery dissipation in the branches of the switches S1 and S4.

4. Energy built up in the inductor L1 during diode reverse recovery.

5. Energy supplied to load CL directly from the supply PS via the switch S2 above and beyond replenishment.

6. Energy removed from the load CL directly to ground via the switch S5 above and beyond rest energy.

FIG. 3 is a detailed circuit diagram of an embodiment of a matrix display driver in accordance with the invention. References in this Figure identical to those in FIG. 1 denote the same components, signals, or nodes. The circuit of FIG. 3 differs from the circuit of FIG. 1 in that the diodes D11 and D13 have been deleted, and that a switch circuit has been added which is connected parallel to the inductor L1. In the embodiment in accordance with the invention as shown in FIG. 3, the switch circuit comprises two series arrangements both arranged between the nodes Nj and Nc. The first series arrangement comprises a diode D3, an ideal switch S3 and a resistor R3. The diode D3 has a cathode directed towards the node Nc. The second series arrangement comprises a diode D9, an ideal switch S6 and a resistor R6. The diode D9 has a cathode directed towards the node Nj.

A control circuit CC supplies switching signals to control the switches S1 to S6.

FIG. 4 shows waveforms of signals occurring in the circuit of FIG. 3. The voltages shown in FIG. 4 are the same as the ones shown in FIG. 2 and are accordingly labeled identically.

Let it be assumed that the circuit of FIG. 3 has been active long enough for the buffer capacitor CB to settle halfway between the supply and ground potential (i.e. Vb=Vcc/2). The load CL is assumed to be at ground potential with respect to the sustain side (the scan side of the load CL forms a virtual ground because it is switched to ground during the active phase of this circuit). All active switches are open at start.

The cycle begins when switch S1 closes at the instant t1'. Energy is then sent to the load CL from the buffer CB. When the switch S1 closes, the floating end of the inductor L1 (node Nj) is clamped to the buffer voltage Vb via the diode D1. Current then builds up through the inductor L1 until the load voltage Vc equals the buffer voltage Vb at the instant t2'. After this, the voltage VL1 across the inductor L1 reverses and hence the current IL1 decreases. The switch S3 (enabling the flywheel diode D3 to conduct) is closed before the end of the energy recovery cycle any time after the voltage across the inductor L1 reverses (from the instant t2' onwards to the instant t3'). The inductor current IL1 reaches zero at the instant t3'. If diodes were ideal, then at this point the current IL1 through the inductor L1 and the switch S1 would cease. However, diodes have a reverse recovery time, which means that a small reverse current (energy from the load CL to the buffer CB) builds up in the inductor L1 before the diode D1 goes into reverse. However, the current IL1 through the inductor L1 must be continuous when the diode D1 stops conducting, and thus the capacitance Cj at the node Nj charges up until the flywheel diode 3 closes due to forward bias and the rest of the inductor current IL1 flows back to the inductor L1 through this diode D3. The voltage VL1 across the inductor L1 is now approximately plus one diode drop. This means that the negative current through the inductor L1 decreases. This voltage drop VL1 across the inductor L1 is far less than in the case of the prior-art circuit so that the rate of decrease of the current IL1 through the inductor L1 is lower than in the prior-art circuit. The energy remaining in the inductor L1 once the diode D3 stops conducting (which is far lower than in the first circuit) then oscillates back and forth with the stray capacitance CJ. The switch S2 (the switch through which the current for arcing is supplied after gas breakdown) is closed after the energy recovery cycle (at the instant t5'). At this point, the remaining energy is supplied to the load capacitance CL from the power supply PS.

A similar set of events occurs at the instant t6' when the load voltage Vc is brought back to zero and the energy is returned to the buffer Cb. The switch S4 closes, the diode D6 conducts and the node Nj is clamped to the buffer voltage Vb. This gives rise to a reverse voltage across the inductor L1, and a current builds up from the load CL to the buffer CB through it. The switch S6 closes, in this example, 150 to 300 ns later, activating the second flywheel diode D9. The current IL1 though the inductor L1 changes direction (goes positive). When the diode D6 stops conducting, the capacitance Cj at node Nj is discharged until the flywheel diode D9 is forward biased. At this point, the inductor current IL1 flows through this diode D9. The voltage VL1 across the inductor L1 is now approximately minus one diode drop. This means that the positive current through the inductor decreases until the diode D9 stops conducting. The small amount of energy in the inductor L1 then oscillates back and forth with the stray capacitance Cj, and the average voltage at the node Nj is equal to the load voltage VC (i.e. ground potential). The switch S5 closes, in this example 300 ns later, helping to drain the charge out of the load CL.

The embodiment of the invention shown in FIG. 3 offers an improved EMI behaviour as compared with the prior-art circuit due to the shorter current flow and the lower inductor residual energy.

The driver circuit in accordance with the invention offers some savings now but these will become more pronounced if the cycle time is reduced and/or Schottky flywheel diodes become applicable (currently the breakdown voltage is insufficient and the plasma voltages are too high).

The delay of the instant at which the switches S2 and S5 are closed until after the energy recovery branches have ceased to conduct (for example, the switches S2 and S5 are closed 400 ns after the switches S1 and S4, respectively), removes losses due to energy supplied to load CL directly from the supply PS via the switch S2 above and beyond replenishment, and due to energy removed from the load CL directly to ground via the switch S5 above and beyond rest energy, respectively. Although this switch-on delay improves the efficiency, it is not essential to the invention.

The energy built up in the inductor L1 during diode reverse recovery may be reduced if the supply VB is decoupled with a capacitor. This effect is due to the fact that the inductor current IL1 is forced into charging the supply decoupling capacitor Cp, and this energy is reused later. On the other hand, this same charge is drawn out of the load capacitor CL reducing its voltage Vc, which causes increased replenishment losses in the switch S5. Given the fact that about 50% of the replenishment energy is lost, this means that the losses are more or less unchanged if supply decoupling is performed (otherwise they increase). The real problem with this approach is that, without the extra switch circuit connected in parallel with the inductor L1, if the same gas breakdown time exists, the value of the inductor L1 must be slightly less than before in order to end energy recovery before the switches S2 and S5 are switched on. This causes a poorer performance due to the circuit resistance including switches and diodes.

FIG. 5 shows a matrix display and a block diagram of circuits driving the matrix display. The matrix display shown is a PDP of the kind in which the n plasma channels PC1, . . . , PCn extend in the horizontal direction, and the m data electrodes DE1, . . . , DEm extend in the vertical direction. Intersections of the plasma channels PC1, . . . , PCn and the data electrodes DE1, . . . , DEm are associated with the pixels. A pair of cooperating select electrode SEi and common electrode CEi is associated with a corresponding one of the plasma channels PCi. A select driver SD supplies scan pulses to the n select electrodes SE1, . . . , SEn. A common driver CD supplies common pulses to the n common electrodes CE1, . . . , CEn. A data driver DD receives a video signal Vs and supplies m data signals to the m data electrodes DE1, . . . , DEm. A timing circuit TC receives synchronization signals S belonging to the video signal Vs to supplies control signals Co1, Co2, and Co3 to the data driver DD, the select driver SD, and the common driver CD to control the timing of the pulses and signals supplied by these drivers.

During the addressing phase of the PDP, the plasma channels PC1, . . . , PCn are usually ignited one by one. An ignited plasma channel PCi has a low impedance. The data voltages on the data electrodes determine an amount of charge in each of the plasma volumes (the pixels) associated with the data electrodes and the low impedance plasma channel PCi. A pixel preconditioned by this charge to produce light during the sustain period succeeding the addressing period will be lit during this sustain period. A plasma channel PCi which has a low impedance is further referred to as a selected line (of pixels). During the addressing phase, the data signals to be stored in the pixels of a selected line are supplied line by line by the data driver DD. During the sustaining phase, the select driver and the common driver supply select pulses and common pulses, respectively to all the lines in which data has been stored during the preceding addressing phase. The pixels precharged to be lit will produce light whenever the associated plasma volumes are ignited. A plasma volume will be ignited when it is precharged to do so and the sustain voltage supplied across the plasma volume by the associated select electrode and common electrode changes by a sufficient amount. The number of ignitions determine the total amount of light produced by the pixel. In a practical implementation, the sustain voltage comprises pulses of alternating polarity. The voltage difference between the positive and the negative pulses is selected to ignite plasma volumes precharged to produce light, and not ignite the plasma volumes precharged so as not to produce light.

The invention is particularly useful during the sustain period wherein many plasma volumes will be ignited at the same time. All these plasma volumes form a large capacitance between the select electrodes and the common electrodes. In practice, this capacitance is even larger because these electrodes have a capacitive coupling with other parts of the flat panel display. In this situation, the capacitance CL is formed by the capacitance mentioned in the previous sentence. The capacitance CL may be constituted by pixels of one or a group of the select electrodes. The switches S1 to S6 are part of either the select driver SD or the common driver CD.

Although FIG. 5 shows a special PDP, the invention is relevant to other PDPs. For example, the plasma channels may extend in the vertical direction, adjacent plasma channels may have an electrode in common. Or more generally, the invention is relevant to all flat panel displays wherein a voltage across a capacitance has to change polarity regularly, such as PDPs, LCDs, or EL displays.

It should be noted that the above-mentioned embodiments illustrate rather than limit the invention, and that those skilled in the art will be able to design many alternative embodiments without departing from the scope of the appended claims.

The circuit is described with respect to the sustain function in a Plasma display panel (PDP). The circuit can be adapted for use in column and scan circuits in a PDP, and as anode switch and ramp-generator functions in Plasma Addressed Liquid crystal displays, and as the drive circuit for LCDs.

In the Figures, the load capacitance CL is connected to ground. In practice, for example for a Plasma Display Panel, the load capacitance CL may be connected between the scan and sustain electrodes as usual. Both ends of the load capacitor CL then receive pulses.

In the claims, any reference signs placed between parentheses shall not be construed as limiting the claim. Use of the verb "to comprise" and its conjugations does not exclude the presence of elements or steps other than those stated in a claim. The invention can be implemented by means of hardware comprising several distinct elements, and by means of a suitably programmed computer. In the device claim enumerating several means, several of these means can be embodied by one and the same item of hardware.

What is claimed is:

1. An energy recovery matrix display driver circuit for generating a voltage having a periodically changing polarity across a capacitive load, said driver circuit comprising:

an inductor being coupled to the capacitive load, a first switch for creating, during a resonance period, a resonant circuit including the inductor and the capacitive load to change said voltage from a first polarity to a second polarity, and a second switch for coupling, after the resonance period, the capacitive load to a power supply voltage having the second polarity, a switch circuit connected in parallel with the inductor for circulating a current through the inductor in a loop formed by said switch circuit and said inductor, said loop being closed not later than an instant at which said current changes polarity at the end of the resonance period, and a control circuit for controlling the first switch, the second switch, and the switch circuit to periodically open and close.

2. An energy recovery matrix display driver circuit as claimed in claim 1, wherein the switch circuit comprises a series arrangement of a diode and a controlled switch, said series arrangement being connected in parallel with the inductor, said controlled switch being closed not later than the instant at which said current changes polarity at the end of the resonance period, said diode being poled to conduct said current after it has changed polarity.

3. An energy recovery matrix display driver circuit as claimed in claim 2, wherein the switch circuit further comprises a series arrangement of a further diode and a further controlled switch, said further series arrangement being connected in parallel with the inductor, said further controlled switch being closed not later than an instant at which said current changes polarity at the end of a further resonance period in which the voltage across the capacitive load changes polarity in an opposite direction with respect to the first-mentioned resonance period, said further diode being oppositely poled with respect to the first-mentioned diode.

4. An energy recovery matrix display driver circuit as claimed in claim 1, wherein the control circuit is adapted to close the second switch after the instant at which said loop is closed.

5. A matrix display apparatus comprising a matrix display panel with a matrix of pixels associated with intersecting electrodes, and an energy recovery matrix display driver circuit for generating a voltage having a periodically changing polarity across a capacitive load, said driver circuit comprising:

an inductor being coupled to the capacitive load, a first switch for creating, during a resonance period, a resonant circuit including the inductor and the capacitive load to change said voltage from a first polarity to a second polarity, and a second switch for coupling, after the resonance period, the capacitive load to a power supply voltage having the second polarity, a switch circuit connected in parallel with the inductor for circulating a current through the inductor in a loop formed by said switch circuit and said inductor, said loop being closed not later than an instant at which said current changes polarity at the end of the resonance period, and a control circuit for controlling the first switch, the second switch, and the switch circuit to periodically open and close.

6. An energy recovery matrix display driver circuit for generating a voltage having a periodically changing polarity across a capacitive load, said driver circuit comprising:

an inductor being coupled to the capacitive load;

a first switch for creating, during a resonance period, a resonant circuit including the inductor and the capacitive load to change said voltage from a first polarity to a second polarity;

a first current path, including at least one diode and a second switch, for passing current, after the resonance period, from a power supply voltage having the second polarity to the capacitive load;

a second current path, including at least one diode and an additional switch, for selectively passing current from the capacitive load to a common node having the first polarity;

a switch circuit connected in parallel with the inductor for circulating a current through the inductor in a loop formed by said switch circuit and said inductor, said loop being closed not later than an instant at which said current changes polarity at the end of the resonance period; and a control circuit for controlling the first switch, the second switch, the additional switch and the switch circuit to periodically open and close.

7. An energy recovery matrix display driver circuit as claimed in claim 6, wherein the common node is shared by each of the inductor, the capacitive load, the first current path, and the second current path.

8. An energy recovery matrix display driver circuit as claimed in claim 6, wherein the control circuit is adapted for controlling the switch circuit in order to limit electromagnetic interference.

9. An energy recovery matrix display driver circuit as claimed in claim 6, wherein the control circuit is adapted for controlling the switch circuit in order to limit the circulating current.

* * * * *